US005135834A

United States Patent [19]

Hanatani et al.

[11] Patent Number: 5,135,834

[45] Date of Patent: Aug. 4, 1992

[54] ELECTROPHOTOGRAPHIC POLYVINYL ACETAL LAYER CONTAINING ELEMENT AND PROCESS OF PRODUCING

[75] Inventors: Yasuyuki Hanatani; Yasufumi Mizuta; Kaname Nakatani, all of Osaka, Japan

[73] Assignee: Mita Industrial Co., Ltd., Osaka, Japan

[21] Appl. No.: 604,238

[22] Filed: Oct. 29, 1990

[30] Foreign Application Priority Data

Oct. 27, 1989 [JP] Japan ..... 1-280729

[51] Int. Cl.[5] ..... G03G 5/14; G03G 5/147

[52] U.S. Cl. ..... 430/131; 430/60; 430/66; 430/67; 430/132

[58] Field of Search ..... 430/60, 131, 132, 66, 430/67

[56] References Cited

U.S. PATENT DOCUMENTS 4,515,882 5/1985 Mammino ..... 430/58

*Primary Examiner*—Roland Martin

*Attorney, Agent, or Firm*—Cushman, Darby & Cushman

[57] ABSTRACT

An electrophotographic photosensitive element having a layer containing polyvinyl acetal, wherein the layer is formed by coating a coating composition containing the polyvinyl acetal and being compounded with a solution comprising an acetylacetone complex salt, an alcohol and water, and a process of producing an electrophotographic photosensitive element having a layer containing polyvinyl acetal, wherein the layer is provided by the steps of:

preparing (A) a solution of an acetylacetone complex salt dissolved in a mixed solvent of an alcohol and water, and (B) a solution containing polyvinyl acetal;

mixing the solutions (A) and (B) to provide a coating composition (C);

coating the coating composition (C) on a constituting layer or a conductive substrate; and drying.

9 Claims, No Drawings

ELECTROPHOTOGRAPHIC POLYVINYL ACETAL LAYER CONTAINING ELEMENT AND PROCESS OF PRODUCING

FIELD OF THE INVENTION

This invention relates to a coating composition suitable for use in an electrophotographic photosensitive element and to a process of producing the coating composition. More particularly, the invention relates to an electrophotographic photosensitive element having one or more layers containing polyvinyl acetal as a film-forming material and to a process of producing the same.

BACKGROUND OF THE INVENTION

In an image-forming apparatus, such as a copying machine utilizing a so-called Carlson process, electrophotographic photosensitive elements having single layer type or double layer type photosensitive layer containing functional materials are used. Generally, a charge generating material and a charge transfer material are used in a resin as a film-forming or binding material. Recently, these materials have been used increasingly due to the advantages that various materials can be selected, the freedom of functional design and excellent producibility.

Also, in electrophotographic photosensitive elements having the aforesaid photosensitive layer, generally it is the practice to form a surface protective layer containing a resin as a film-forming or binding material on the photosensitive layer for improving the abrasion resistance of the photosensitive layer.

Various resins have been used as the film-forming material for the photosensitive layer and surface protective layer. Of the known resins that are used, polyvinyl acetal is most suitable since the resin compound exhibits excellent dispersing properties for components such as the charge generating and charge forming materials, and excellent storage stability.

However, in photosensitive layers using polyvinyl acetal, a large amount of hydroxyl groups remain in the polyvinyl acetal and the photosensitive layer has a high hygroscopicity. Thus, this leads to problems for the photosensitive element as to resistance to surrounding conditions and the hydroxyl groups act as traps for charge carriers (positive holes) generated by light exposure. Also, the hydroxyl groups react with acid contained in the layer to form $—OH_2^+$ group, which form space charges which influences the counter potential of the photosensitive element, with the result that the sensitivity of the photosensitive element is lowered.

Similarly, in the case of surface protective layers containing polyvinyl acetal, a large amount of hydroxyl groups remain and the layer has a high hygroscopicity and reduced resistance to surrounding conditions. Also, there is a possibility that the mechanical strength of the protective layer is lowered by absorbing moisture and the adjacent photosensitive layer is deteriorated by the moisture passing through the surface protective layer.

It is known to use polyvinyl acetal dissolved in a solvent as a coating composition. Since polyvinyl acetal containing a large amount of hydroxyl groups, as described above, has a high solubility in an organic solvent, such as an alcohol, this leads to other problems in a lamination type photosensitive layer. For example, the polyvinyl acetal swells greatly or is dissolved by the organic solvent contained in the coating composition for the layer. This can occur when an upper layer is formed on a lower layer containing polyvinyl acetal, or when a surface protective layer is formed on an upper layer containing polyvinyl acetal of a lamination type photosensitive layer or on a single layer type photosensitive layer containing polyvinyl acetal. Thus, the interface between two layers becomes indistinct, which adversely influences the sensitivity characteristics of the photosensitive element. In particular, when the layer containing polyvinyl acetal is a surface protective layer, the strength of the surface protective layer is lowered.

Thus, it has been proposed to reduce the amount of hydroxyl groups remaining in the layer formed from polyvinyl acetal by adding an acetylacetone complex salt (metal acetylaceto-nate). The complex salt is hydrolyzed during drying of the coating composition causing a condensation reaction with the hydroxyl groups in the polyvinyl acetal in the coating composition. The acetylacetone complex salt is usually combined with the polyvinyl acetal in a solid state, such as a powder, etc., because of storage stability. However, since the acetylacetone complex salt has poor solubility in organic solvents such as alcohols, it requires lengthy stirring to uniformly dissolve the acetylacetone complex salt in a coating composition. Thus, there is the problem that it takes a long time to prepare the coating composition.

Also, when a large amount of the acetylacetone complex salt is added as a solid to the coating composition to further decrease the amount of hydroxyl groups remaining in the layer formed subsequently, it is difficult to dissolve the entire amount in the coating composition. This leads to the following problems.

First of all, an uneven coating is liable to occur when particles of the acetylacetone complex salt exist in the undissolved state in the coating composition. Additionally, the complex salt particles remain in the coated layer as foreign matter or as lengthwise stripes on the coated layer due to the movement of the particles on the coated layer in the coating direction. This results in a non-uniform coating layer and leads to defects in the images formed. Also, non-uniform distribution of acetylacetone complex salt in the coating layer forms portions containing a small amount of hydroxyl groups and portions containing a large amount of hydroxyl groups. In the case of a photosensitive layer, non-uniform distribution of the complex salt affects the sensitivity characteristics and the resistance to surrounding conditions. In the case of a surface protective layer, non-uniformity affects the resistance to surrounding conditions and the mechanical strength of the coating layer.

The present invention provides polyvinyl acetal coating compositions that can be formed into layers in an electrophotographic photosensitive element that obviate the above-noted problems.

SUMMARY OF THE INVENTION

An object of the present invention is to provide an electrophotographic photosensitive element having a large amount of an acetylacetone complex salt dispersed in a polyvinyl acetal coating layer to decrease the amount of hydroxyl groups remaining in the coating.

Another object of the invention is to provide polyvinyl acetal containing coating compositions having reduced amounts of hydroxyl groups remaining in layers formed therefrom.

A further object of the invention is to provide a method for forming polyvinyl acetal-containing coating compositions in a reduced amount of time.

Another object of the invention is to provide polyvinyl acetal-containing coating layers useful for electrophotographic photosensitive elements of uniform thickness and substantially free of surface imperfections and foreign matter.

Another object of this invention is to provide a process of producing electrophotographic photosensitive elements.

It has been found that these and other objects can be attained by incorporating an acetylacetone complex salt as a solution in a mixture of an alcohol and water into polyvinyl acetal containing coating compositions which compositions are useful in the formation of layers, e.g. photosensitive and surface protective layers, for electrophotographic photosensitive elements.

The addition of acetylacetone complex salts to coating compositions as a solution :as been investigated. However, it has been found that the acetylacetone complex salt has poor solubility in ordinary organic solvents as described above and a homogeneous solution thereof cannot be formed by using an organic solvent alone. Thus, as the result of the investigation with various mixed solvents, it has been discovered that by using a mixed solvent composed of an alcohol and a small amount of water, a larger amount of an acetylacetone complex salt can be easily and quickly dissolved therein. The resulting homogeneous solution of the complex salt can be obtained without the adverse effects discussed above with respect to the prior art compositions.

Accordingly, the electrophotographic photosensitive element of the present invention has a layer containing polyvinyl acetal formed by coating a coating composition containing the polyvinyl acetal and being compounded with a solution comprising an acetylacetone complex salt, an alcohol and water.

Also, the process of producing an electrophotographic photosensitive element having a layer containing polyvinyl acetal in the present invention comprises the layer being provided by the steps of:

preparing (A) a solution of an acetylacetone complex salt dissolved in a mixed solvent of an alcohol and water, and (B) a solution containing polyvinyl acetal;

mixing the solutions (A) and (B) to provide a coating composition (C);

coating the coating composition (C) on a constituting layer or a conductive substrate; and drying.

DETAILED DESCRIPTION OF THE INVENTION

The present invention can be applied to various kinds of electrophotographic photosensitive elements having layer(s) containing polyvinyl acetal as a film-forming or binding material (hereinafter, the layer is referred to as "specific layer"). The specific layer can comprise the following layers.

(1) A single layer type organic photosensitive layer containing a charge generating material and a charge transfer material in a resin as a film-forming material.

(2) At least one layer in a lamination type organic photosensitive unit composed of a charge generating material in a resin as a film-forming material and a layer containing a change transfer material in a resin as a film-forming material.

(3}A charge transfer layer in a composite type photosensitive unit composed of a charge generating layer formed by a thin film or layer of a semiconductor material and the charge transfer layer as in above (2) laminated on the charge generating layer.

(4) A surface protective layer formed on the photosensitive layer in each type (1), (2), or (3) described above.

The coating composition for the specific layer is coated on a constituting layer (e.g., a charge generating material, a charge transfer material, an intermediate layer, and an undercoat layer, etc.) or a conductive substrate of the electrophotographic photosensitive element depending on each purpose to form the specific layer.

The acetylacetone complex salt which is added to the polyvinyl acetal coating composition includes various chelating compounds belonging to a (mono)acetylacetonate complex salt composed of acetylacetone and a metal atom, a bisacetylacetonate complex salt, a trisacetyl-acetonate complex salt, and a tetrakistacetonate complex salt. The complex salts represented by the following formula (I) or (II) can be used in this invention.

$$M(C_5H_7O_2)_n \quad (I)$$

$$M(C_5H_7O_2)_{n-m}R^1{}_m \quad (II)$$

wherein M represents a trivalent or tetravalent metal; $R^1$ represents an alkyl group or an alkoxy group; n represents 3 when M is a trivalent metal or 4 when M is a tetravalent metal; and m is an integer of 2 or lower.

As alkyl groups or alkoxy groups for $R^1$, alkyl groups or alkoxy groups having 1 to 5 carbon atoms are preferable and those having 2 or 4 carbon atoms are more preferable. (it is preferred that the number of the carbon atom is even.) In the above formulae M is preferably aluminum or zirconium.

Alcohols that can be used in forming a solution of the acetylacetone complex salt together with water, include for example, alkanols such as ethanol, methanol, isopropanol, butanol; β-oxyethyl methyl ether (methylcellosolve), β-oxyethyl ether (ethylcellosolve), β-oxyethyl propyl ether (propylcellosolve), and butyl-β-oxyethyl ether (butylcellosolve) and mixtures thereof. Butanol and butylcellosolve are presently preferred due to low volatility and safety.

There is no particular restriction on the concentration of the acetylacetone complex salt in the solution composed of alcohol and water in this invention. However, it is preferred that the concentration is in the range of from 0.05 to 0.5 mol/liter. It is more preferable that the concentration is in the range of from 0.1 to 0.25 mol/liter. If the concentration of the acrylacetone complex salt is less than 0.05 mol/liter, a large amount of the solution must be compounded with the coating composition to decrease sufficiently the amount of the hydroxyl groups remaining in the specific layer. If the amount of hydroxyl groups is not decreased sufficiently, the viscosity of the coating composition is lowered and the coating property and film-forming property thereof is reduced and it takes a long time to dry the coated layer. On the other hand, if the concentration of the acetylacetone complex salt is over 0.5 mol/liter, it takes a long time to dissolve the entire amount of the salt and it takes extra time to prepare the solution. In addition, non-uniform layers may be formed which can cause unevenness or lengthwise stripes on the specific layer formed, defective images, reduction in sensitivity characteristics, strength of the layer, and resistance to surrounding conditions.

There is no particular restriction on the concentration of water in the complex salt solution in this invention, but it is necessary that the concentration of water is in the range of from 1 to 10 mol/liter. It is preferred that the concentration of water is in the range of from 2 to 5 mol/liter. If the concentration of water is less than 1 mol/liter, the effect of water on the solubility of the salt is not sufficient and it is difficult to dissolve the entire amount of the acetylacetone complex salt in the solution. As a result, it takes additional time to prepare the solution and there is a possibility of the formation of uneven coatings, defective images, reduction in the sensitivity characteristics, and strength of the layer, and resistance to surrounding conditions. On the other hand, if the concentration of water is over 10 mol/liter, the acetylacetone complex salt is hydrolyzed, whereby the amount of hydroxyl groups remaining in the specific layer can not be reduced sufficiently when a pigment, for example, or other additives, are used together, and the dispersibility thereof is lowered.

There is no specific proportional relation between the concentration of the acetylace-tone complex salt and the concentration of water in the complex salt solution. However, it is desireable that solutions containing a larger amount of the acetylacetone complex salt also contains a larger amount of water in order to maintain the polarity of the acetylacetone complex salt at a desirable level and solution stable.

There is no specific restriction on the compounding ratio of the complex salt solution with the polyvinyl acetal-containing coating composition for a specific layer, but the compounding amount of the solution is adjusted such that the acetylacetone complex salt is compounded in the coating composition in an amount of from 0.01 to 2.0 equivalents, more preferably from 0.1 to 1.0 equivalents, to the hydroxyl groups of the polyvinyl acetal contained in the coating composition. If the compounding ratio of the acetylacetone complex salt to the hydroxyl groups of the polyvinyl acetal is less than 0.01 equivalent, the addition effect of the acetylacetone complex salt obtained is not sufficient. This results in a large amount of hydroxyl groups remaining in the layer and sensitivity is lowered, resistance to surrounding conditions deteriorates, and the resistance to organic solvent can not be improved sufficiently. On the other hand, if the compounding ratio of the acetylacetone complex salt to the hydroxyl groups of the polyvinyl acetal is over 2.0 equivalents, the aforesaid characteristics are improved but the stability is lowered.

The polyvinyl acetal which is added to the coating composition for forming the specific layer as a film-forming or binding component is produced by the acetylation of polyvinyl alcohol or polyvinyl acetate and has a structure corresponding to a copolymer of vinyl acetal, vinyl acetate, and vinyl alcohol as shown in following formula (III).

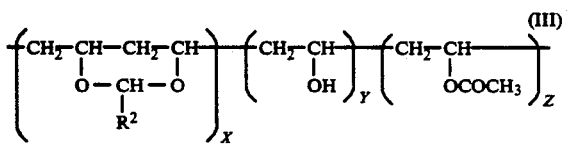

(III)

wherein $R^2$ represents a hydrogen atom or an alkyl group having from 1 to 3 carbon atoms.

There is no particular restriction on the ratio of X, Y, and Z in the formula (III), that is, the ratio of the vinyl acetal component, the vinyl acetate component and the vinyl alcohol component in this invention. It is preferred that the ratio of the vinyl alcohol component in the polyvinyl acetal is not more than 13% by weight. The reason is as follows. If the ratio of the vinyl alcohol component is over 13% by weight, after decreasing hydroxyl groups by addition of the acetylacetone complex salt, a large amount of hydroxyl groups remain in the layer, thereby lowering of the sensitivity, deteriorating resistance to surrounding conditions, etc., can not be prevented sufficiently and the resistance to organic solvent can not be improved sufficiently.

Examples of suitable polyvinyl acetals that can be used are polyvinyl formal, polyvinyl acetoacetal, and polyvinyl butyral. Polyvinyl butyral is more preferred in this invention.

Examples of suitable organic solvents that can be used for forming the coating compositions of the invention include the above-illustrated alcohols; halogenated hydrocarbons such as dichloromethane, carbon tetrachloride, chlorobenzene, etc.; ketones such as acetone; methyl ethyl ketone, methyl isobutyl ketone, cyclohexanone, etc.; aromatic hydrocarbons such as tenzene, toluene, xylene, etc.; 1,4-dioxane; tetrahydrofuran; dimethylformamide; and dimethylacetamide. Of the above solvents, alcohols having compatibility with the alcohol solution of the acetylacetone complex salt (e.g., isopropyl alcohol, n-buthanol, and butyl cellosolve, etc.) are particularly preferably used.

The amount of polyvinyl acetal in the specific layer of the present invention is preferably from 8 to 30 % by weight, more preferably from 10 to 17 % by weight.

Also, for the specific layers of the invention, a conventional thermosetting resin or a thermo-plastic resin, which can be used in other organic layer than the specific layer of the invention, can be used together in any desired range provided the polymer does not adversely influence the properties of the specific layer of the invention.

In the production of the electrophotographic photosensitive element of this invention, other materials than the solution being compounded with the polyvinyl acetal-containing coating composition for forming the specific layer can be constructed as is conventional.

For example, amorphous chalcogenite or amorphous silicone can be used in a composite type photosensitive layer, in a charge generating; layer, or a thin layer of a semiconductor material.

The thin layer-form of charge generating layer composed of semiconductor material can be formed on a conductive substrate by any known thin-film forming method such as by vacuum vapor deposition, glow discharging decomposition and the like.

Examples of charge transfer materials that can be present in the specific layer of the invention include high molecular compounds such as poly-N-vinylcarbazole, polyvinylpyrene, polyacenaphthylene, etc.; nitro compounds such as dinitroanthracene, etc.; conjugated unsaturated compounds such as 1,1-bis(4-diethylaminophenyl)-4,4-diphenyl-1,3-butadiene, etc.; tetracyanoethylene; fluorenone series compounds, succinic anhydride, maleic anhydride, dibromomaleic anhydride, triphenylmethane series compounds, oxadiazole series compounds, styryl series compounds, carbazole series compounds, pyrazoline series compounds, amine derivatives, hydrazone series compounds, m-phenylenediamine series compounds, indole series compounds, oxazole series compounds, isooxazole series compounds, thiazole series compounds, thiadiazole series compounds, imidazole series compounds, pyrazole series compounds, pyrazoline series compounds, triazole series compounds, and condensed polycyclic compounds. In the charge transfer materials noted above, high molecular materials having photoconductivity, such as poly-N-vinylcarbazole, can be used with polyvinyl acetate as film-forming materials.

On the other hand, when a specific layer of the invention is a single layer type organic photo-sensitive layer or a charge generating layer of a laminated layer type organic photosensitive unit, the charge generating materials contained in the specific layer are, for example, powders of semiconductor materials and fine crystals of compounds of an element belonging to group II-VI of the periodic table. Representative examples include, ZnO, CdS, etc.; pyrylium salts, azoic compounds, bisazoic compounds, phthalocyanine series compounds, ansanthrone series compounds, indigo series compounds, triphenylmethane series compounds threne series compounds, toluidine series compounds, pyrazoline series compounds, quinacrydone series compounds, and pyrrolopyrrole series compounds.

These charge generating materials can be used singly or as a mixture thereof.

Also, when the specific layer is a surface protective layer formed on a photosensitive layer, the surface protective layer can further contain, if necessary, usual amounts of other resins, an electric conductivity imparting agent, a benzoquinone series ultraviolet absorbent, and the like, in addition to polyvinyl acetal.

In the various photosensitive layers, the content of the charge generating agent in the single layer type organic photosensitive layer is preferably in the range of from 2 to 20 parts by weight, and preferably from 3 to 15 parts by weight to 100 parts by weight of the resin as a film-forming material. Also, the content of the charge transfer material is preferably in the range of from 40 to 200 parts by weight, and particularly from 50 to 100 parts by weight to 100 parts by weight of the aforesaid resin. If the content of the charge generating material is less than 2 parts by weight or the content of the charge transfer material is less than 40 parts by weight, the sensitivity of the photosensitive element becomes insufficient and the residual potential is increased. On the other hand, if the content of the charge generating material is over 20 parts by weight or the content of the charge transfer material is over 200 parts by weight, the abrasion resistance of the photosensitive element becomes insufficient.

There is no particular restriction on the thickness of the single layer, type organic photosensitive layer but it is preferred that the thickness is about the same as that of a conventional single layer type organic photosensitive layer, that is, in the range of from 10 to 50 μm, particularly from 15 to 25 μm.

In each layer constituting the lamination type organic photosensitive unit, the content of the charge generating material in the charge generating layer is preferably in the range of from 5 to 500 parts by weight, and particularly from 10 to 250 parts by weight to 100 parts by weight of a resin as a film-forming material. If the content of the charge generating material is less than 5 parts by weight, the charge generating faculity is too small, while if the content is over 500 parts by weight, the adhesion of the layer with a substrate or other layer is lowered.

There is no particular restriction on the thickness of the charge generating layer, but the thickness is preferably in the range of from 0.01 to 3 μm, and particularly from 0.1 to 2 μm.

In each layer constituting the lamination type organic photosensitive unit or the composite type photosensitive units, the content of the charge transfer material in the charge transfer layer is preferably in the range of from 10 to 500 parts by weight, and particularly from 25 to 200 parts by weight to 100 parts by weight of a resin as a film-forming material. If the content of the charge transfer material is less than 10 parts by weight, the charge transferring faculty is insufficient while if the content is over 500 parts by weight, the mechanical strength of the charge transfer layer is lowered.

There is no particular restriction on the thickness of the charge transfer layer but the thickness is preferably in the range of from 2 to 100 μm, and particularly from 5 to 30 μm.

Also, the thickness of the surface protective layer is preferably in the range of from 0.1 to 10 μm, and particularly from 2 to 5 μm.

In addition, the photosensitive layer(s) and surface protective layer can contain conventionally known antioxidants, whereby the deterioration of the functional components, such as the charge transfer material, which have structures easily influenced by oxidation can be prevented.

The conductive substrate or substrate for the photosensitive layer can be any desired shape such as a sheet, a drum and the like, corresponding to the mechanism and structure of the image-forming apparatus for the electrophotographic element.

The conductive substrate can be constituted wholly by an electrically conductive material such as a metal or a substrate itself is formed by a material having no electric conductivity and electric conductivity can be imparted to the surface thereof.

Electrically conductive materials which can be used in forming the conductive substrate include various metals such as aluminum, copper, tin, platinum, silver, vanadium, molybdenum, chromium, cadmium, titanium, nickel, palladium, indium, stainless steels, brass, etc. and mixtures thereof.

Of the above-mentioned metals, aluminum having a surface which has been subjected to an alumite treatment is preferred and aluminum which has been anodically oxidized by an alumite sulfate method and subjected to a sealing treatment by nickel sulfate is particularly preferred.

Electric conductivity can be imparted to the surface of a substrate composed of a material having no electric conductivity, for example a synthetic resin substrate, by applying a thin layer or film composed of an electrically conductive material, such as aluminum oxide, tin oxide, indium oxide, etc. The metal film or layer can be formed on the surface of a synthetic resin substrate or a glass substrate by any known thin film-forming method such as a vacuum vapor deposition method, a wet plating method, and the like; a structure having a film or foil of the metal laminated on a surface of the synthetic resin substrate or glass substrate; or a structure having a material for imparting an electric conductivity applied into the surface of the synthetic resin substrate or glass substrate can be employed.

In addition, if necessary, the conductive material can be subjected to a surface treatment with a surface treating agent such as a silane coupling agent, a titanium coupling agent, etc., for improving adhesion with the photosensitive layer.

The layers containing resins as film-forming materials, such as a photosensitive layer, a surface protective layer, and the like, can be formed by preparing a coating composition for each layer containing the necessary components, applying the coating composition, in succession, on the conductive substrate and drying or setting the layers. Also, during preparation of the coating composition, the coating composition can further contain a surface active agent or a leveling agent for improving physical properties such as dispersibility, coating property, and the like.

The coating compositions can be prepared by conventional methods using a mixer, a ball mill, a paint shake, a sand mill, an attritor, a ultrasonic dispersing means, and the like.

The present invention is now illustrated in greater detail by reference to the following examples which, however, are not to be construed as limiting the present invention in any way.

EXAMPLE 1 to 5

A mixture of 10 parts by weight of polyacrylate (U-100, trade name, made by Unitika Ltd.) as a film-forming material, 10 parts by weight of 4-(N,N-diethylamino)benzaldehyde-N,N-diphenylhydrazone as a charge transfer material, and 100 parts by weight of dichloromethane as a solvent was mixed by stirring in a homo mixer to provide a coating composition for a charge transfer layer. The coating composition was coated on an aluminum tube having an outer diameter of 78 mm and a length of 340 mm and dried by heating for 30 minutes at 90° C. to form a charge transfer layer having a thickness of about 20 μm.

Then, a n-butanol solution containing 0.2 mol/liter of tetrakisacetylacetonate zirconium $Zr(C_5H_7O_2)_4$ (made by Nippon Kagaku Sangyo Co., Ltd.) and 3.0 mol/liter of water was prepared.

Also, a mixture composed of 160 parts by weight of 2,7-dibromoansanthrone (made by Imperial Chemical Industries Limited) as a charge generating material, 40 parts of metal free phthalocyanine (made by BASF A.G.) as a charge generating agent, 100 parts by weight of polyvinyl butyral (Dénca Butyral #5000-A, trade name, made by Denki Kagaku Kogyo Co., Ltd.) as a film-forming material, and 2,000 parts by weight of n-butanol as a solvent was mixed with the n-butanol solution such that the amount (equivalent) of tetrakisacetylacetinate zirconium to the hydroxyl groups in the polyvinyl butyral became the value shown in the table below and the resultant mixture was mixed with stirring for 2 hours in a ball mill to provide a coating composition for a charge generating layer. The coating composition was coated on the charge generating layer and dried by stirring for 30 minutes at 110° C. to form a charge generating layer having a thickness of about 0.5 μm.

Then, a silane hydrolyzed product solution (Tosguard 520, trade name, made by Toshiba Silicone Co., Ltd., non-volatile solid content 21% by weight) was compounded with an antimony-doped tin oxide fine powder (solid solution particles of tin oxide and antimony oxide, made by Sumitomo Cement Co., Ltd., containing 10% by weight antimony) at 50% by weight to the non-volatile solid component in the solution and the mixture was mixed by stirring for 150 hours in a ball mill to provide a coating composition for a surface protective layer. The coating composition was coated on the charge generating layer and set by heating for one hour at 110° C. to form a surface protective layer having a thickness of about: 2.5 μm. Each coating of the coating compositions for the charge transfer layer, the charge generating layer and the surface protective layer was carried out by means of a dip coating method.

Thus, 5 kinds of drum type electrophotographic photosensitive elements were prepared.

COMPARATIVE EXAMPLES 1 to 3

By following the same procedure as Examples 1 to 5 described above except that in place of the tetrakisacetylacetonate zirconium solution, a tetrakisacetylacetonate zirconium power was compounded with the coating composition at 0.2 equivalent to the hydroxyl groups in the polyvinyl butyral, the mixture was mixed by stirring for a time shown in the following table to prepare the coating composition for the charge generating layer, 3 kinds of electrophotographic photosensitive elements were prepared.

COMPARATIVE EXAMPLES 4 to 6

By following the same procedure as Comparative Examples 1 to 3 except that the tetrakisacetylacetonate zirconium powder was compounded at 1.0 equivalent to the hydroxyl groups in the polyvinyl butyral, 3 kinds of electrophotographic photosensitive elements were prepared.

COMPARATIVE EXAMPLE 7

By following the same procedure as Examples 1 to 5 described above except that the tetrakisacetylacetonate zirconium solution was not compounded with the coating composition for the charge generating layer, an electrophotographic photosensitive element was prepared.

The following tests were applied to the electrophotographic photosensitive elements prepared in the above examples and comparative examples.

Surface Potential Measurement

Each electrophotographic photosensitive element was mounted on an electrostatic copying test apparatus (Gentec Cynthia 30M Type, made by Gentec) and after positively charging the surface, the surface potential $V_1$ s.p. (V) was measured.

Half Decay Exposure Amount, Residual Potential Measurement

Each electrophotographic photosensitive element in the charged state was exposed using a halogen lamp which was the exposure light source of the electrostatic copying test apparatus under the conditions of an exposure intensity of 0.92 mW/cm$^2$ and an exposure time of 60 msec., the time required for decaying the surface potential $V^1$ s.p. (V) to ½ thereof, and the half decay exposure amount $E_{\frac{1}{2}}$ (μJ/cm$^2$) was calculated.

Also, the surface potential after 0.4 seconds after initiation of the exposure was measured as the residual potential V r.p. (V).

Appearance

The appearance of the surface protective layer was visually observed.

The results obtained are shown in the following table.

TABLE 1

| | $Zr(C_5H_7O_2)_4$ Compounding Equivalent Amount | Stirring time | $V_{1s.p.}$ (V) | $E_{\frac{1}{2}}$ ($\mu J/cm^2$) | $V_{r.p.}$ (V) | Appearance |
|---|---|---|---|---|---|---|
| Example 1 | 0.2 | 2 hr | 722 | 22.1 | 142 | good |
| 2 | 0.4 | 2 hr | 704 | 22.7 | 144 | good |
| 3 | 0.8 | 2 hr | 711 | 21.6 | 138 | good |
| 4 | 1.0 | 2 hr | 725 | 21.9 | 145 | good |
| 5 | 1.5 | 2 hr | 713 | 22.0 | 139 | good |
| Comparative Example 1 | 0.2 | 2 hr | 727 | 28.6 | 209 | uneven coating, foreign matters and lengthwise stripes |
| 2 | 0.2 | 12 hr | 708 | 26.1 | 164 | uneven coating, foreign matters and lengthwise stripes |
| 3 | 0.2 | 24 hr | 711 | 22.4 | 148 | good |
| 4 | 1.0 | 2 hr | 706 | 27.9 | 202 | uneven coating, foreign matters and lengthwise stripes |
| 5 | 1.0 | 12 hr | 719 | 25.6 | 170 | uneven coating, foreign matters and lengthwise stripes |
| 6 | 1.0 | 24 hr | 720 | 23.2 | 154 | uneven coating, foreign matters and lengthwise stripes |
| Comparative Example 7 | — | — | 723 | 32.6 | 231 | uneven coating |

From the results shown in the above table, it can be seen from Comparative Examples 1 to 6 wherein a powder of tetrakisacetylacetonate zirconium was compounded with the coating composition, that Comparative Example 3 only, in which the compounding amount of the zirconium powder was 0.2 equivalent and the stirring time was 24 hours, could a good charge generating layer be formed. However, in other comparative examples, the tetrakisacetylacetonate zirconium powder could not be completely dissolved in the coating composition, thus forming an uneven coating, containing foreign matter, and lengthwise stripes. A good charge generating layer could not be formed.

Also, in Comparative Example 7, tetrakisacetylacetonate zirconium was not compounded, and which resulted in an uneven coating and the half decay exposure amount was large, the residual potential was high, etc., i.e., sufficient sensitivity characteristics were not obtained.

On the other hand, in Examples 1 to 5, even when 1.5 equivalent or less amount of tetrakisacetylacetonate zirconium was compounded and the mixture was stirred for 2 hours only, the charge generating layers had essentially the same sensitivity characteristics as those in Comparative Example 3 which required 24 hours for stirring and, in addition, exhibited a good external appearance.

As described above, in this invention, the acetylacetone complex salt for decreasing the amount of remaining hydroxyl groups caused by the existence of polyvinyl acetal is compounded with a coating composition for forming a layer containing the polyvinyl acetal in a state of a solution thereof in a mixed solvent of an alcohol and water. A larger amount of the acetylacetone complex salt can be uniformly compounded, whereby hydroxyl groups remaining in the layer can be uniformly and greatly decreased. Also, as described above, since the acetylacetone complex salt is in a solution state which can be easily compounded with the coating composition, the coating composition can be easily prepared and the problems of uneven coating and foreign matter on the coated layer caused by the remaining acetylacetone complex salt in the coating composition as an undissolved state can be solved and substantially eliminated and minimized.

We claim:

1. A process of producing an electrophotographic photosensitive element having a layer containing polyvinyl acetal, wherein the layer is provided by the steps of:

prepararing (A) a solution of an acetylacetone complex salt dissolved in a mixed solvent of an alcohol and water, wherein the concentration of water in the complex salt solution is in the range 1 to 10 mol/l, and (B) a solution containing polyvinyl acetal;

mixing the solutions (A) and (B) to provide a coating composition (C);

coating the coating composition (C) on a constituting layer or a conductive substrate; and drying.

2. A process of producing an electrophotographic photosensitive element as claimed in claim 1, wherein the concentration of said acetylacetone complex salt in the solution (B) is 0.05 to 0.5 mol/liter.

3. A process of producing an electrophotographic photosensitive element as claimed in claim 1, wherein the step of mixing the solutions (A) and (B) is carried out such that the acetylacetone complex salt in the solution (B) is compounded in an amount of from 0.01 to 2.0 equivalents to the hydroxyl groups of the polyvinyl acetal in the coating composition (C).

4. A process of producing an electrophotographic photosensitive element as claimed in claim 1, wherein said acetylacetone complex salt is represented by general formula (I) or (II):

$$M(C_5H_7O_2)_n \quad (I)$$

$$M(C_5H_7O_2)n\text{-}mR^1{}_m \quad (II)$$

wherein M represents a trivalent or tetravalent metal; $R^1$ represents an alkyl group or an alkoxy group; n represents 3 when M is a trivalent metal or 4 represents when M is a tetravalent metal; and m is an integer of 2 or lower.

5. A process as claimed in claim 1, wherein the concentration of water in the acetylacetone complex salt solution is in the range 2 to 5 mol/l.

6. A process as claimed in claim 1, wherein the alcohol is selected from one or more members of the group consisting of methanol, ethanol, isopropanol, butanol, β-oxyethyl methyl ether, β-oxyethyl ether, β-oxyethyl propyl ether, and butyl-β-oxyethyl ether.

7. A process as claimed in claim 6, wherein the alcohol is selected from butanol and butyl-β-oxyethyl ether.

8. A process as claimed in claim 1, wherein said layer further contains a charge generating material.

9. A process as claimed in claim 8, wherein said layer is a charge generating layer in a lamination type organic photosensitive unit.

* * * * *